United States Patent [19]

Bernhard

[11] Patent Number: 4,763,848

[45] Date of Patent: Aug. 16, 1988

[54] WINDING SUPPORT FOR USE IN MANUFACTURING SADDLE-TYPE COILS

[75] Inventor: Wilfred Bernhard, Altbach, Fed. Rep. of Germany

[73] Assignee: Alcatel N.V., Netherlands

[21] Appl. No.: 502,896

[22] Filed: Jun. 10, 1983

[30] Foreign Application Priority Data

Jul. 7, 1982 [DE] Fed. Rep. of Germany ..... 3225289

[51] Int. Cl.[4] ..... B21F 3/00

[52] U.S. Cl. ..... 242/1; 242/7.07; 29/605; 140/92.1

[58] Field of Search ..... 242/1, 4 B, 4 R, 4 C, 242/1.1 R, 1.1 E, 7.07; 140/92.1, 92.2; 29/605

[56] References Cited

U.S. PATENT DOCUMENTS

| | | | |
|---|---|---|---|
| 733,633 | 7/1903 | Drees | 140/92.2 |
| 2,496,913 | 2/1950 | Grundmann | 140/92.2 |
| 3,512,233 | 5/1970 | Mancini | 29/605 X |
| 3,855,694 | 12/1974 | Van Der Heijde | 140/92.1 X |
| 3,912,182 | 10/1975 | Ishikawa | 29/605 X |
| 3,968,566 | 7/1976 | Schubert | 140/92.1 X |
| 4,093,132 | 6/1978 | Christiana et al. | 242/4 R X |

*Primary Examiner*—John Petrakes
*Assistant Examiner*—Katherine Matecki
*Attorney, Agent, or Firm*—Peter C. Van Der Sluys

[57] ABSTRACT

By providing steps on the inner form of the winding support used for the winding of saddle-type coils, the turns of the saddle-type coil are exactly fixed in their positions. In this way the tolerances of the magnetic field produced with the aid of such coils become small, with this improving the suitability of the coils for use with self-convergent deflection systems. The manufacture of the saddle-type coils with the aid of the winding support according to the present invention is more inexpensive than the manufacture of saddle-type coils wound onto grooved coilformers, and more exact than if stepless inner forms were to be used.

10 Claims, 3 Drawing Sheets

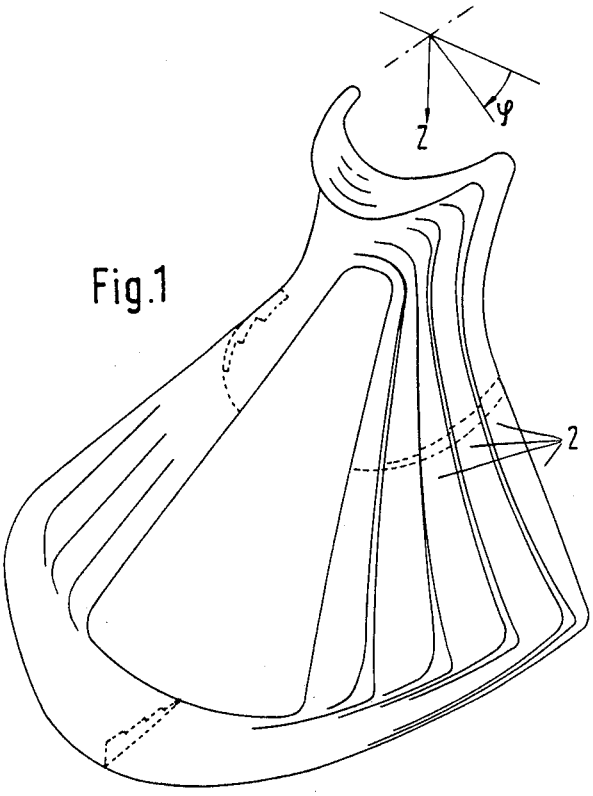
Fig.1
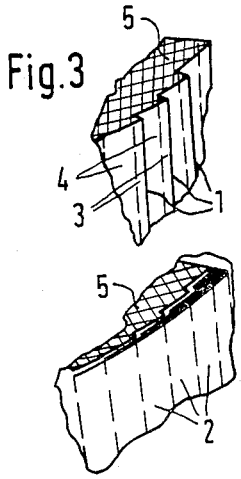
Fig.3
Fig.4
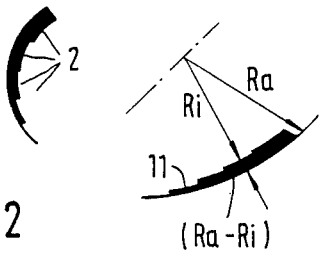
Fig.2

WINDING SUPPORT FOR USE IN MANUFACTURING SADDLE-TYPE COILS

BACKGROUND OF THE INVENTION

The present invention relates to a multisectional winding support comprising at least one inner and one outer form, as well as pins capable of being supplied in a controlled manner, for the winding of saddle-type coils comprising at least one string of winding wires, for use with deflection units of color-picture tubes. The saddle-type coils of a deflection unit serve to produce the magnetic fields effecting the deflection of the electron beams in color picture tubes.

Such saddle-type coils are named after their saddle shape and are constructed to have such a form so as to be self-convergent. Self-convergent saddle-type coils require no auxiliary currents in order to achieve convergence. Convergence is achieved when the accelerated electrons of all three electron beams, while being deflected in both the vertical and the horizontal direction, and owing to the temporal variation of the magnetic fields, exactly intersect at each point on the screen of the color picture tube.

The winding support comprises at least two members capable of being assembled, i.e., the inner and the outer form.

The inner form has the outwardly arched negative inner contour, and the outer form has the inwardly arched negative outer contour of the saddle-type coil to be wound between the inner form and the outer form.

The inner form of such a winding support or device only serves as the coilform as long as the coil is being wound. As long as the saddle-type coil is still positioned in the wind-support, the saddle-type coil is made self-supporting by way of bonding and/or heat bonding. After that, the saddle-type coil is removed from the spaced apart inner and outer forms of the winding support and, together with further coils, is assembled on a plastic sleeve or collar to form a deflection unit.

The winding of the individual winding wires in the coil is determinative of both the shape and the strength of the magnetic field to be produced by the coil. A slight deviation of the wire run from the rated value has an influence upon the magnetic field and, consequently, upon the deflection of the electron beams. This becomes noticeable in the form of convergence errors on the screen. Accordingly, a prerequesite for a useful winding technique is the good reproducibility of the position of the individual wires in the saddle-type coil.

This, however, is not easy to accomplish under mass-production requirements. Depending on the type of wire insulation, the wire lies differently to the already existing turns during the winding operation. The mechanical properties of the wire, such as the sliding ability, hardness of the wire, or the surface quality of the coilform are not always sufficiently constant. To a considerable extent, these properties depend e.g., on the temperature and the relative humidity.

An improved reproducibility of both the position and the run of the wires of the individual turns can be achieved by another conventional technique according to which the wire turns are wound directly onto a grooved winding collar. Considering that this fixed "coilform" of plastic is not removed, there is no need for the coil to be finally bonded or heat-bonded. The good reproducibility is safeguarded by placing the wires into the exactly defined grooves provided for on the winding collar, throughout its entire length.

One disadvantage of this conventional technique resides in the increased costs due to the precise manufacture of the collar and the long time required for performing the winding operation.

SUMMARY OF THE INVENTION

An object of the present invention is to prevent the wires from taking different courses in the windings while manufacturing the saddle-type coils and to achieve this without having to use expensive coilformers.

A feature of the present invention is the provision of a multisectional winding support for the winding of a saddle-type coil including at least one string of winding wires for use in a deflection unit of a color picture tube comprising an inner form having steps on an outer surface thereof; and an outer form surrounding at least a part the inner form, the outer form having a smooth surface adjacent the outer surface of the inner form determining in cooperation with the outer surface of the inner form the shape of the saddle-type coil.

BRIEF DESCRIPTION OF THE DRAWINGS

Above-mentioned and other features and objects of this invention will become more apparent by reference to the following description taken in conjunction with the accompanying drawing, in which:

FIG. 1 is a perspective view of a saddle-type coil having a stepped cross-section in accordance with the principles of the present invention;

FIG. 2 is a cross-sectional view taken through the saddle-type coil of FIG. 1;

FIG. 3 is a three-dimensional illustration of part of the surface of the inner portion of the coil former according to the principle of the present invention;

FIG. 4 is a three-dimensional illustration of the same part as FIG. 3, but with additionally shown portions of the winding strings;

DESCRIPTION OF THE PREFERRED EMBODIMENT

Figure 5:
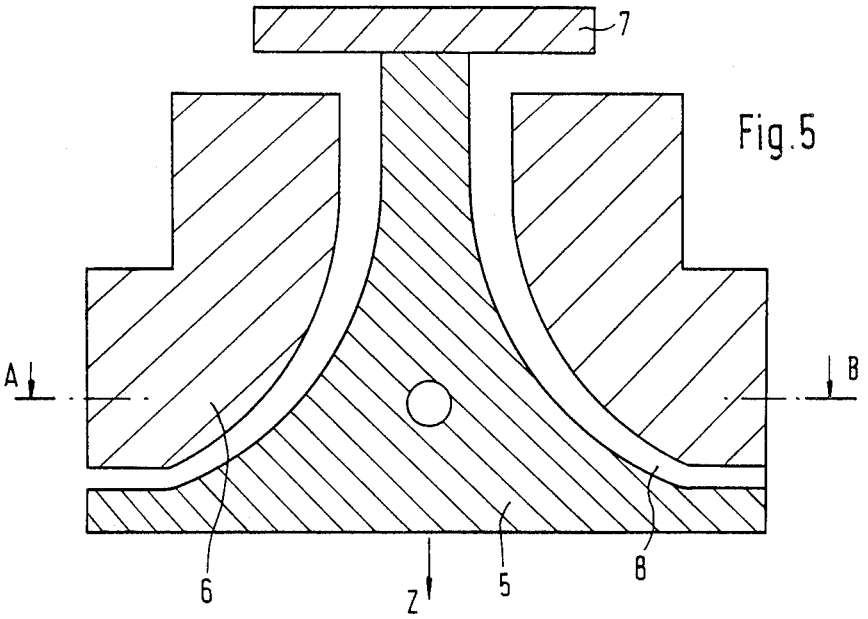
FIG. 5 is a cross-sectional view taken on line C-D of the coilformer of FIG. 6.

FIG. 1 is a perspective view of a saddle-type coil wound with the aid of the device (support) according to the present invention. The wires of the winding strings 2 of the saddle-type coil extend along the steps (not shown in FIG. 1) of the inner form of the winding support. The winding height 11, that is $R_a - R_i$, of the strings of winding wires, increases on account of the steps 1, as can be recognized from FIG. 2. From the diagram of polar coordinates as shown in FIG. 1, the steps are seen to take such a course that in case of a fixed azimuth Y, the radius R increases continuously as Z increases and that, in the case of a constant Z, the radius at first increases stepwisely as Y increases, and then stepwisely decreases again as Y becomes greater than 90°. The cross section of the saddle-type coil as shown in FIG. 2, is also denoted in FIG. 1 by the dotted lines. Further cross sections extending vertically in relation to the course of the strings of winding wires would permit recognizing corresponding steppings. The stepping along the course of the strings of winding wires is not equally strong at all points. The stepping, in fact, can disappear at points where the direction in the course of the strings of winding wires changes considerably. This is chiefly the case where the winding wire is placed around winding pins inserted during the winding operation, that is, where the position of the wire is already sufficiently fixed by the winding pins. In order to permit the saddle-type coil to be removed from the device without being adversely affected by the steps, the finished saddle-type coil is lifted in the Z-direction off the inner form. The Z-direction is the direction extending parallel in relation to the main axis of the color picture tube.

The steps 1 on the inner form 5 of the support, a small section being shown in FIG. 3 in a three-dimensional representation, are shown to have stepping surfaces 3 and stepped surfaces 4 which extend almost vertically in relation to the neighbouring stepping surfaces 3.

As is additionally shown in FIG. 4, the strings of winding wires 2 are applied positively to the steps during the winding operation.

Figure 6:
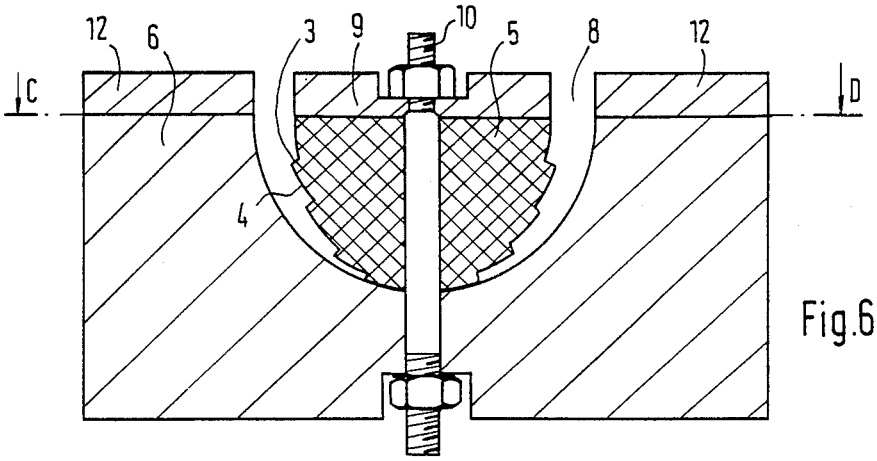
FIG. 6 is a cross-sectional view taken on line A-B of the coilformer of FIG. 5.

FIGS. 5 and 6 show two cross sectional views of the support used for the winding of saddle-type coils, with FIG. 5 being a section taken on line C-D of FIG. 6, and FIG. 6 being a section taken on line A-B of FIG. 5. The wire forming the saddle-type coil is wound into the winding space 8 between the inner form 5 and the outer form 6. Via the mounting board 9, both the inner and the outer parts are held together with the aid of the connecting bolt 10. For removing the wound and also heat-bonded, if so required, saddle-type coil, the cover 7 is removed and after unscrewing the connecting bolt 10, the saddle-type coil together with the inner form 5 is removed from the outer form 6. After that, the saddle-type coils and the stepped inner form 5 are separated from each other in the Z-direction.

Figure 8:
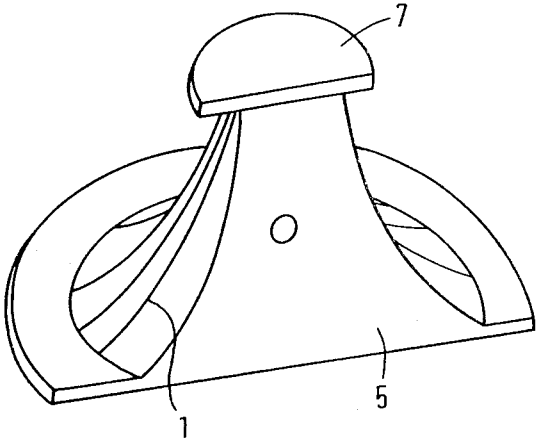
FIG. 8 is a perspective view of the inner form of the multisectional winding support in accordance with the principles of the present invention.
Figure 7:
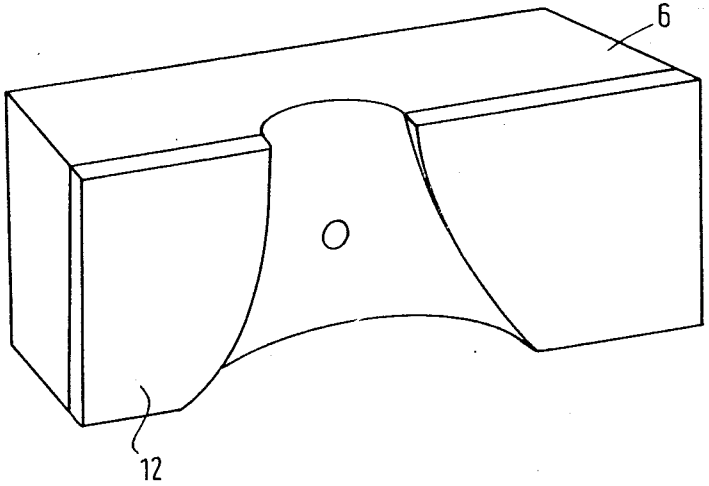
FIG. 7 is a perspective view of the outer form of the multisectional winding support in accordance with the principles of the present invention.

The perspective views of the outer form in FIG. 7 and of the inner form in FIG. 8 serve to improve the descriptiveness of FIGS. 5 and 6.

With the aid of the support according to the present invention, saddle-type coils can be wound in accordance with the heat-bonding technique, with a high accuracy, a good reproducibility and a low percentage of rejects.

For this purpose, the inner form of the winding support (device), unlike the conventional types of inner forms, is stepped. By this there is achieved a precise positioning of the wires as well as precise reproducibility during manufacture.

By employing the winding support or device according to the present invention the wire is wound into a device serving as a coilformer, and is thereafter subjected to heat bonding. The contour of the coilformer no longer extends continuously, but is stepped. It includes a rotation-symmetrical outer part along which the wire can slide well, and of a stepped inner form by which the wire is retained in the respective positions defined by the steps. By this construction of the stepped inner form according to the present invention, the wire is retained within defined areas. There will result a well-reproducible, self-convergent, self-supporting saddle-type coil having a rotation-symmetrical outer contour and a stepped inner contour. The stepped inner form is constructed in accordance with requirements for achieving optimal convergence and maximum reproducibility.

Accordingly, the main advantages of the present invention are:

(a) lower manufacturing costs than with the conventional technique employing coilformers, and (b) improved reproducibility of the saddle-type coils than when using the conventional stepless inner form.

While we have described above the principles of our invention in connection with specific apparatus, it is to be clearly understood that this description is made only by way of example and not as a limitation to the scope of our invention as set forth in the objects thereof and in the accompanying claims.

I claim:

1. A multisectional winding support for the winding of a saddle-type coil including at least one string of winding wires for use in a deflecting unit of a color picture tube comprising:

an inner form having steps on an outer surface thereof, said steps of said inner form are provided along an inside radius of said inner form which continuously increases along a main axis of said saddle-type coil for a fixed azimuth angle and in the case of a fixed position along said main axis said inside radius increases in a step-like manner as said azimuth angle increases up to 90° at which time said inside radius decreases in a step-like manner when said azimuth angle increases beyond 90°; and an outer form surrounding at least a part said inner form, said outer form having a smooth surface adjacent said outer surface of said inner form determining in cooperation with said outer surface of said inner form the shape of said saddle-type coil.

2. A winding support according to claim 1, wherein each of said steps include a stepping surface extending perpendicular to the stepped surface.

3. A winding support according to claim 2, wherein each of said stepping surfaces are provided in a plane extending almost parallel to said main axis.

4. A winding support according to claim 3, wherein said smooth surface of said outer form has a radius which continuously increases along said main axis, said radius being larger than or equal to said inner radius of said inner form at the same azimuth angle and position along said main axis, said radius being constant for each position along said main axis with an increasing azimuth angle.

5. A winding support according to claim 1, wherein said smooth surface of said outer form has a radius which continuously increases along said main axis, said radius being larger than or equal to said inner radius of said inner form at the same azimuth angle and position along said main axis, said radius being constant for each position along said main axis with an increasing azimuth angle.

6. A winding support according to claim 1, wherein each of said steps include a stepping surface extending perpendicular to the stepped surface.

7. A winding support according to claim 6, wherein each of said stepping surfaces are provided in a plane extending almost parallel to said main axis.

8. A winding support according to claim 7, wherein said smooth surface of said outer form has a radius which continuously increases along a main axis, said radius being larger than or equal to an inner radius of said inner form at the same azimuth angle and position along said main axis, said radius being constant for each position along said main axis with an increasing azimuth angle.

9. A winding support according to claim 6, wherein said smooth surface of said outer form has a radius which continuously increases along a main axis, said radius being larger than or equal to an inner radius of said inner form at the same azimuth angle and position along said main axis, said radius being constant for each position along said main axis with an increasing azimuth angle.

10. A winding support according to claim 1, wherein said smooth surface of said outer form has a radius which continuously increases along a main axis, said radius being larger than or equal to an inner radius of said inner form at the same azimuth angle and position along said main axis, said radius being constant for each position along said main axis with an increasing azimuth angle.

* * * * *